US012071767B2

(12) United States Patent
Dhinjan

(10) Patent No.: US 12,071,767 B2
(45) Date of Patent: Aug. 27, 2024

(54) WALL PLASTERING BEAD

(71) Applicant: Budha Singh Dhinjan, Warwick (GB)

(72) Inventor: Budha Singh Dhinjan, Warwick (GB)

( * ) Notice: Subject to any disclaimer, the term of this patent is extended or adjusted under 35 U.S.C. 154(b) by 0 days.

(21) Appl. No.: 17/629,710

(22) PCT Filed: Jun. 3, 2020

(86) PCT No.: PCT/GB2020/051331
§ 371 (c)(1),
(2) Date: Jan. 24, 2022

(87) PCT Pub. No.: WO2021/014115
PCT Pub. Date: Jan. 28, 2021

(65) Prior Publication Data

US 2022/0275650 A1 Sep. 1, 2022

(30) Foreign Application Priority Data

Jul. 25, 2019 (GB) ..... 1910659

(51) Int. Cl.
*E04F 13/06* (2006.01)

(52) U.S. Cl.
CPC ..... *E04F 13/068* (2013.01); *E04F 2013/063* (2013.01)

(58) Field of Classification Search
CPC .... E04F 13/068; E04F 2013/063; E04F 13/06
See application file for complete search history.

(56) References Cited

U.S. PATENT DOCUMENTS 658,386 A * 9/1900 Mitchell ..... E04F 13/06 52/257
1,748,284 A * 2/1930 Gersman ..... E04F 13/06 52/255

(Continued)

FOREIGN PATENT DOCUMENTS

CN 102575474 7/2012
DE 88 02 263 U1 4/1988

(Continued)

OTHER PUBLICATIONS

Machine_translate_DE102007053473A1 (Year: 2009).*

(Continued)

*Primary Examiner* — Babajide A Demuren
(74) *Attorney, Agent, or Firm* — Foley & Lardner LLP

(57) ABSTRACT

A wall bead (100) is provided for application to adjoining surfaces, typically at a corner of a wall, during coating thereof tin with plaster or other render material. The wall bead comprises a central longitudinally extending portion (102) having first and second longitudinal edges; first and second planar panels (104, 106) extending from the first and second edges respectively; and first and second connection portions (108, 110) extending from the first and second panels respectively. The first and second connection portions each comprise a plurality of teeth (114) protruding therefrom. The first and second panels (104, 106) each comprise a flexible mesh such that they are arranged to conform to a contour of a wall surface. The wall bead is adapted to be flexible to suit the needs of varying shapes, angles and surface profiles of a wall, while having a simple and robust attachment mechanism.

15 Claims, 9 Drawing Sheets

(56) References Cited

U.S. PATENT DOCUMENTS

| | | | | |
|---|---|---|---|---|
| 1,804,564 | A * | 5/1931 | McChesney | E04F 13/06 52/255 |
| 2,904,856 | A * | 9/1959 | Robinson | E04F 13/06 52/255 |
| 5,442,886 | A * | 8/1995 | Iacobelli | E04F 13/06 52/287.1 |
| 6,571,520 | B2 * | 6/2003 | Koenig, Jr. | E04F 13/06 52/287.1 |
| 2011/0030297 | A1 * | 2/2011 | Robertson | B26F 1/384 52/287.1 |
| 2013/0186024 | A1 * | 7/2013 | Rosentiel | E04F 13/06 52/255 |

FOREIGN PATENT DOCUMENTS

| | | | |
|---|---|---|---|
| DE | 10 2006 053 867 | A1 | 6/2008 |
| DE | 10 2007 053 473 | A1 | 5/2009 |
| WO | WO-2011/023971 | A1 | 3/2011 |

OTHER PUBLICATIONS

GB Search Report on GB1910659.0 mailed Nov. 6, 2019 (4 pages).
International Search Report and Written Opinion on PCT Appl PCT/GB2020/051331, mailed Aug. 11, 2020 (11 pages).
Chinese Office Action on CN 202080063021.1 dated Feb. 14, 2023 (9 pages).

* cited by examiner

WALL PLASTERING BEAD

CROSS-REFERENCE TO RELATED APPLICATIONS

This application is a U.S. National Stage Application under 35 U.S.C. § 371 of International Patent Application No. PCT/GB2020/051331, filed on Jun. 3, 2020, which claims priority to Great Britain Patent Application No. 1910659.0, filed on Jul. 25, 2019, the content of each of which is incorporated herein by reference in its entirety.

FIELD OF THE INVENTION

The present invention relates to a wall bead for applying across two adjoining surfaces of a wall, such as a corner, prior to the application of a surface coating thereto.

BACKGROUND TO THE INVENTION

It is well known to apply a surface coating of plaster or other render material, to ceilings and other wall surfaces in buildings. Generally, prior to applying the plaster or the material, an elongate bead of metal is applied along external corners where two intersecting surfaces meet, in order to enable a good finish to be achieved to the corner. The bead also acts to strengthen and protect the corner.

U.S. Pat. No. 4,876,837 discloses a typical corner bead which is formed from an elongate strip of sheet metal and comprises a rounded nose and two mounting flanges extending perpendicular to each other from the opposite sides of the nose. The mounting flanges are apertured to provide a key for the overlying plaster or render.

The corner bead is applied to a corner by passing nails or screws through the apertured mounting flanges into the underlying wall material. However, a disadvantage of this arrangement is that the underlying wall material is often too hard or too soft to readily accept nails or screws and thus the process of applying corner beads can be difficult and time consuming. In order to overcome this problem, it is has been proposed to attach corner beads using an adhesive. However, the corner beads have to be held in place whilst the adhesive sets and it will be appreciated that this is equally as difficult as permanently securing the corner beads. Another disadvantage of using adhesive is that the adhesive has to be allowed to set before the underlying wall is plastered or rendered.

U.S. Pat. No. 5,778,617 discloses a corner bead which attempts to overcome the above-mentioned problems and which comprises a plurality of integral pre-formed barbs along its length for securing the corner bead to underlying wall surfaces formed of plasterboard or other drywall material. In use, when a corner bead is applied to the plasterboard the barbs penetrate the outer layer of the plasterboard and temporarily secure the corner bead to the corner whilst it is plastered over. A disadvantage of this arrangement is that the barbs extend substantially perpendicular to the bead and so once the bead has been fixed to the wall surface it can be very difficult to remove or reposition the bead without unduly damaging the underlying plasterboard.

Additional disadvantages shared by the previous solutions include the rigidity of the outwardly projecting flanges. Such flanges are unsuitable for walls having corners or varying shapes or angles and such, the purpose of the bead to provide a neat, continuous and robust corner of the wall, is eliminated.

It is therefore desirable to provide a solution which overcomes the disadvantages of the current wall beads. Particularly it is desirable to provide a solution which provides improved ease of attachment to a wall, and in some cases more difficult removal, while providing improved flexibility.

SUMMARY OF THE INVENTION

In accordance with a first aspect of the present invention, there is provided a wall bead, the wall bead comprising: a central longitudinally extending portion having a first longitudinal edge and a second longitudinal edge opposing the first edge; a first planar panel extending from the first edge; a second planar panel extending from the second edge; a first connection portion extending from the first panel; and a second connection portion extending from the second panel; wherein the first connection portion and the second connection portion each comprise a plurality of teeth protruding therefrom and distributed along a longitudinal length thereof; and wherein the first and second panel each comprise a flexible mesh or woven material such that the first and second panel are arranged to conform to a contour of a wall surface.

The mesh panels of the present invention preferably provide a level of flexibility in wall beads not previously permitted, with a robust wall attachment mechanism in the form of the teeth protruding from the connection portions. The term "mesh" will be understood by the skilled addressee in the context of the present invention as an interlaced net or lattice structure. A material, such as stainless steel, which is arranged in an interlaced network provides improved flexibility relative to the equivalent material arranged as a substantially continuous, unmeshed structure. Current wall beads may provide panels having regularly interspaced apertures specifically arranged to receive nails or screws. The skilled addressee will appreciate the difference between such panels and the panels of the present invention comprising a mesh or woven material.

In some embodiments, the first panel and the second panel may each comprise a plurality of mesh portions separated by one or more solid portions. The surface area of the first and second panels to be occupied by said mesh portions may be selected during manufacturing to control a flexibility of said panels. A requirement for greater flexibility will require a greater surface area of said panels being formed of said mesh. An embodiment requiring maximum flexibility, for a particularly aggressive or acutely-angled wall corner for example, may comprise first and second panels formed entirely of said mesh. An embodiment requiring semi rigidity, such as for a gentle or curved wall corner may comprise first and second panels each having a first elongate mesh panel portion and a second elongate mesh panel portion separated by a solid panel portion located therebetween. In most embodiments the elongate mesh panel portions will be understood to extend along the length of the wall bead. The term "solid panel portion" will be understood to differentiate from the term "mesh panel portion" due to a lack of, or reduced number of, apertures of the solid panel portion relative to the mesh panel portion.

In some embodiments, the first panel and/or the second panel may comprise teeth. In such embodiments said teeth may protrude from the mesh or, in embodiments comprising first and second panels having one or more solid panel portion, said teeth may protrude from said solid panel portions. In embodiments wherein the first and/or second panel comprises teeth, the teeth are preferably substantially the same as the teeth located on the connection portions. Embodiments will be appreciated wherein the teeth are not the same as the teeth located on the connection portions. For example, teeth located on mesh portions of the panels may be formed during formation of the mesh during manufacture. Punching apertures into the mesh may accompany formation of teeth during said punching process. In embodiments wherein the first and second panels comprise teeth, some preferable examples of said embodiments may comprise teeth opposing the teeth of the corresponding connection portion. For example, teeth protruding form the first panel may in some preferable embodiments oppose the teeth protruding from the first connection portion. Said opposing teeth preferably provide for a more robust connection of the wall bead to a wall surface such that the wall bead requires greater force to disconnect from said wall surface.

In some embodiments the central portion may comprise one or more teeth. Preferably teeth located on the central portion may protrude from a surface of the central portion intended to engage a wall surface. In such embodiments, preferably the central portion comprises an elongate curved portion having a first and second longitudinal edge, a first planar portion extending from the first longitudinal edge and a second planar portion extending from the second longitudinal edge. Preferably the first and second planar portions form guide which aid in aligning the edge of the wall bead with a surface of a wall and also preferably provide improved lateral restraint. Preferably the central portion comprises teeth located on the elongate curved portion, the first planar portion and the second planar portion. Said teeth preferably aid in providing improved connection of the wall bead to a wall surface, and therefore providing more difficult removal.

Embodiments will be appreciated wherein the first and second panels comprise a plurality of panel sections distributed along the length of the respective longitudinal edge of the central portion separated by a space. Wall beads having panels comprising a plurality of panel section preferably provide greater flexibility of the wall bead.

In some embodiments, the teeth may comprise a first set of teeth arranged to extend from a surface of the first connection portion and the second connection portion, and a second set of teeth arranged to extend from a surface of the first connection portion and the second connection portion, the first set of teeth and the second set of teeth positioned in spaced pairs at longitudinal positions along the first connection portion and the second connection portion. In some embodiments, the teeth may comprise a first set of teeth arranged to extend from a surface of the first connection portion and the second connection portion, and a smaller second set of teeth, collocated with the first set of teeth and formed therefrom.

In said embodiments, the second set of teeth may optionally extend from the surface at an angle of less than 90° relative to the surface.

In some preferable embodiments, the teeth may be arranged to protrude from the respective connection portion in a single longitudinal direction along the respective connection portion. In such embodiments, the teeth may optionally extend from the respective connection portion surface at an angle of less than 90° relative to the surface.

In some embodiments, the teeth may each comprise a pointed distal end and are generally triangular in shape. In other embodiments, the teeth may each comprise a generally straight distal end and generally trapezoid in shape. In some such embodiments, the teeth may each comprise a serrated edge having a non-linear profile. Embodiments will be appreciated wherein the teeth are any suitable shape and are arranged to puncture the surface of a wall substrate, such as for example plasterboard, following external force being applied thereto.

The teeth may comprise a first portion proximate the connection portion or the mesh, and a second portion distal to the connection portion or the mesh, the first portion and the second portion being positioned at an angle relative to one another. In such embodiments, the second portion of the teeth is preferably angled relative to the first portion, the angle preferably being obtuse. The term "obtuse" in the context of the present invention will be understood to mean greater than 90° but less than 180°. Teeth comprising said angle preferably provide a more robust connection between the connection portion and the surface of a wall, such that once connected to a wall surface, the wall bead is more difficult to disconnect from said wall surface.

Preferably a front surface of the first and second panels are angularly spaced about the central portion by an angle of less than 180°. More preferably, the angle is substantially 90°.

Preferably the flexible mesh or woven material comprises one selected from the group: stainless steel; mild steel; galvanised metal. Such a material may be a minimesh.

In preferable embodiments, the first connection portion and the second connection portion each comprise a connection portion material which is a continuous, unmeshed material.

Preferably the connection portion material is one selected from the group: stainless steel; mild steel; galvanised metal.

In preferable embodiments, the central portion comprises a central portion material which is a continuous, unmeshed material. Preferably the central portion material is one selected from the group: stainless steel; mild steel; galvanised metal.

In the context of the present invention, the term "flexible" will be understood by the skilled addressee to mean flexible relative to the connection portion and/or the central portion, which in preferable embodiments are a continuous, unmeshed material. It will be appreciated that the first panel material and the second panel material may be the same as the central portion material and/or the connection portion material, but in such embodiments the mesh of the first panel material and the second panel material imparts greater flexibility upon the panels relative to the central portion and/or the connection portion.

Preferably the central portion provides a bridging connection between the first panel and the second panel. In preferable embodiments the bridging connection comprises a generally semicircular profile.

DETAILED DESCRIPTION

Specific embodiments will now be described by way of example only, and with reference to the accompanying drawings, in which.

Figure 1A:
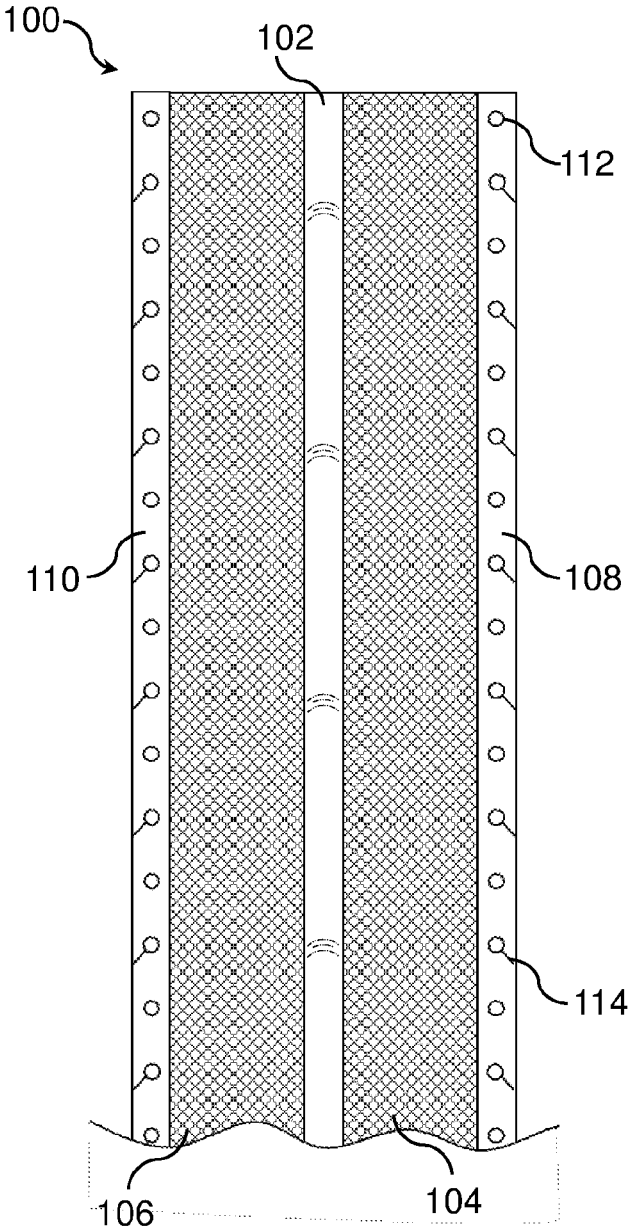
FIG. 1A shows a front view of a first example embodiment of a wall bead according to the present invention.

Referring to FIG. 1A, a front view of an example embodiment 100 is shown of a wall bead 100 according to the first aspect of the present invention. In the example 100 shown, the wall bead 100 comprises an elongate central portion 102 extending longitudinally along the centre of the wall bead 100. Extending outwardly, in a plane defined by a first direction, from the central portion 102 is a first planar panel 104 consisting of a foraminous, stainless steel mesh. The first panel 104 is affixed to the central portion 102 along a first longitudinal edge thereof. The wall bead 100 further comprises a second mesh panel 106, substantially the same as the first mesh panel 104, extending from the central portion 102 in a plane defined by a second direction opposite the first direction. The second panel 106 is affixed to the central portion along a second longitudinal edge thereof, the second edge opposing the first edge. The first panel 104 and the second panel 106 are positioned in their respective planes defining an angle of around 90 degrees therebetween.

Figure 1B:
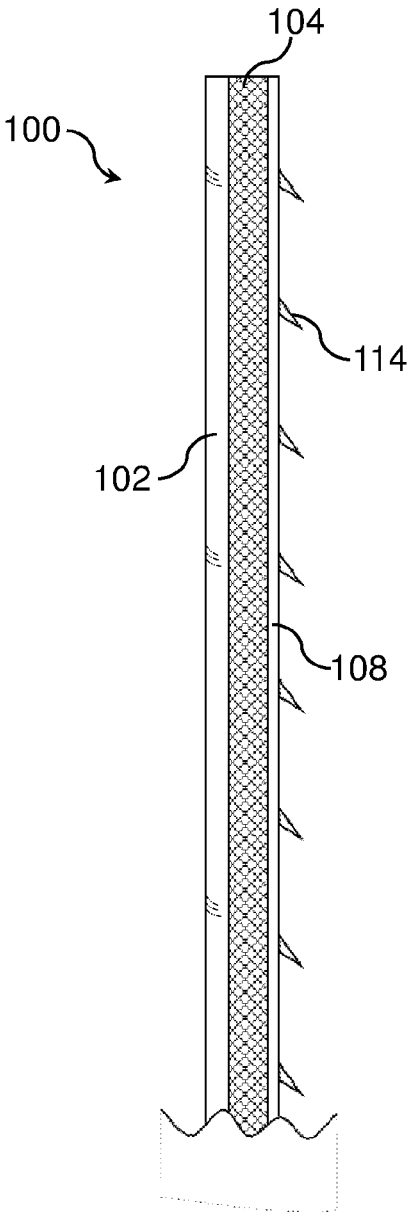
FIG. 1B shows a lateral view of the embodiment of FIG. 1A.
Figure 1C:
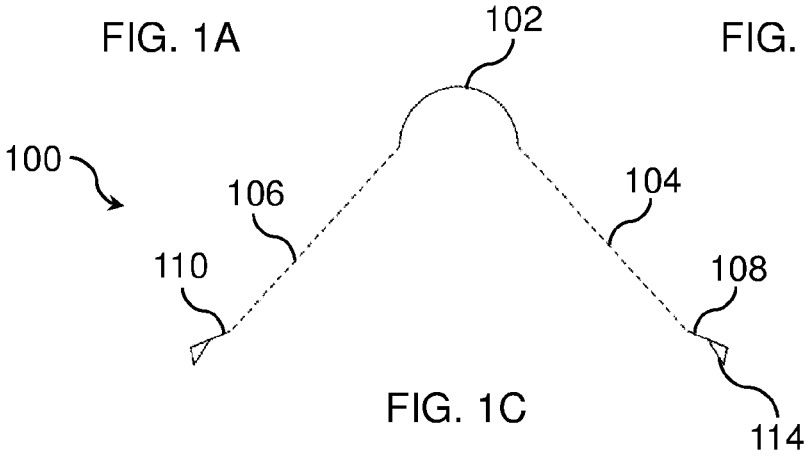

The wall bead 100 of the embodiment shown further comprises a first connection portion 108 extending from the first panel 104. The first connection portion 108 is affixed to the first panel 104 along a longitudinal edge of the first panel 104 distal to the central portion 102. The first connection portion 108 comprises a plurality of apertures 112 spaced evenly along the length of the first connection portion 108. The apertures 112 comprise an aperture diameter sized to receive a nail driven therethrough during fixing of the wall bead 100 to a corner surface of a plasterboard wall. Spaced evenly along the first connection portion 108, and protruding in a single longitudinal direction therefrom, are a plurality of teeth 114, taking the form of stainless steel barbs each formed using a notch in the first connection portion 108. As can be seen from FIG. 1B, the barbs 114 protrude from a surface of the first connection portion 108 at an acute angle relative to the surface, the surface being intended to be directed toward a plasterboard wall for fixation of the wall bead thereto using the barbs 114.

Extending from the second panel 106, and affixed along a longitudinal edge thereof, is a second connection portion 110 which is substantially a mirror image of the first connection portion 108. The second connection portion 110 is affixed to an edge of the second panel 106 distal to the central portion 102.

Figure 10A:
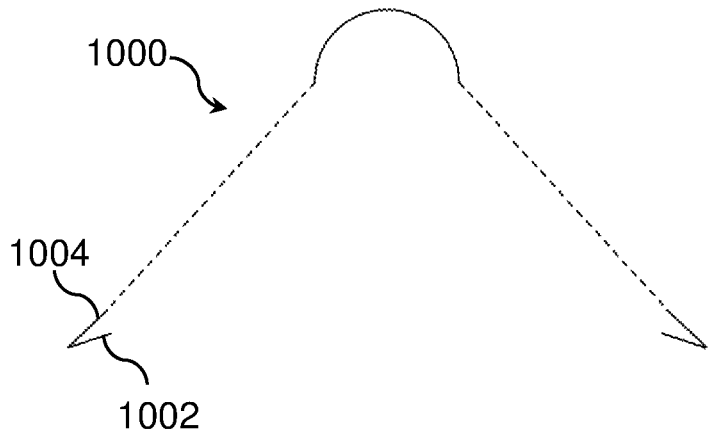
FIG. 10 shows a sectional plan view of the embodiment of FIG. 1A and FIG. 1B.
Figure 10B:
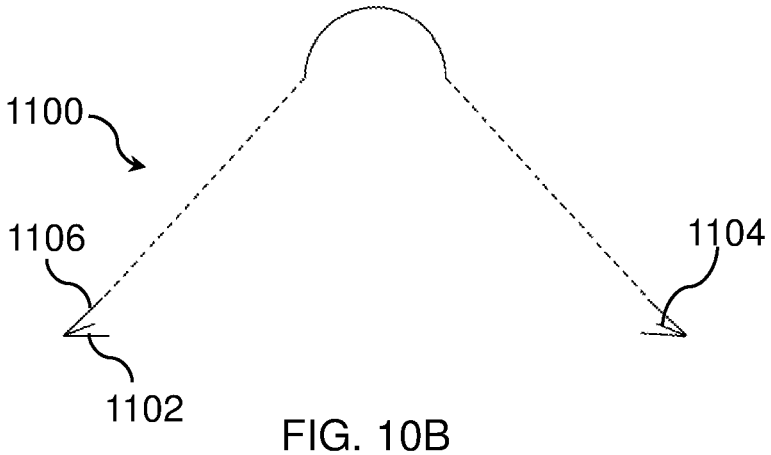
Figure 10C:
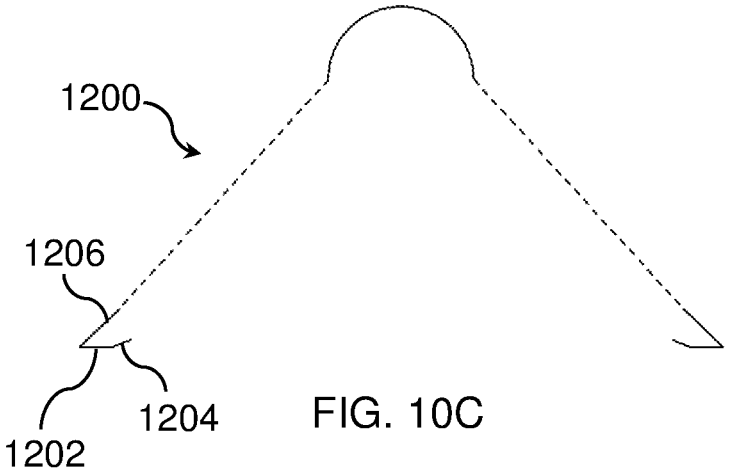

As can be seen from the sectional plan view of FIG. 10, the central portion 102 forms a semicircular bridge between the first panel 104 and the second panel 106. In the embodiment shown, the first panel 104 and the second panel 106 each extend in a plane which is roughly 90 degrees relative the plane of the other of the two panels. As such, the bead 100 is ideally arranged to be positioned about a corner of a plasterboard wall. The flexible mesh of the first panel 104 and the second panel 106 are arranged to deviate from their respective planes shown FIG. 10 such that the panels 104, 106 may conform to the surface of a non-flat wall surface of said plasterboard wall corner.

In use, the wall bead 100 shown is affixed to a corner of a plasterboard wall (not shown) prior to coating said plasterboard wall with plaster. The central portion 102 acts to form a neat, continuous corner of a wall which is robust to wear and tear compared to the underlying plasterboard. The barbs 114 enable affixing of the bead 100 to the plasterboard with minimal effort and without specifically requiring the addition of nails through the apertures 112. The first and second panels 104, 106 of the bead 100 are highly flexible by virtue of the mesh. The enhanced flexibility of the first and second panels 104, 106 permits the bead 100 to conform to a surface of the corner of plasterboard wall easily and with minimal effort. The bead 100 may therefore be specifically suited to applications requiring a flexible beading with enhanced securing/affixing properties, such as those using a bespoke wall shape which may have, for example, a convex, concave, or otherwise non-flat surface. Simultaneous conforming of the bead to the non-flat plasterboard wall surface while fixation occurs is therefore provided. Said simultaneous action is key to providing a solution which is suited to applications requiring simple, fast and effective application of a wall bead to a non-flat surface of a plasterboard wall corner.

Figure 2A:
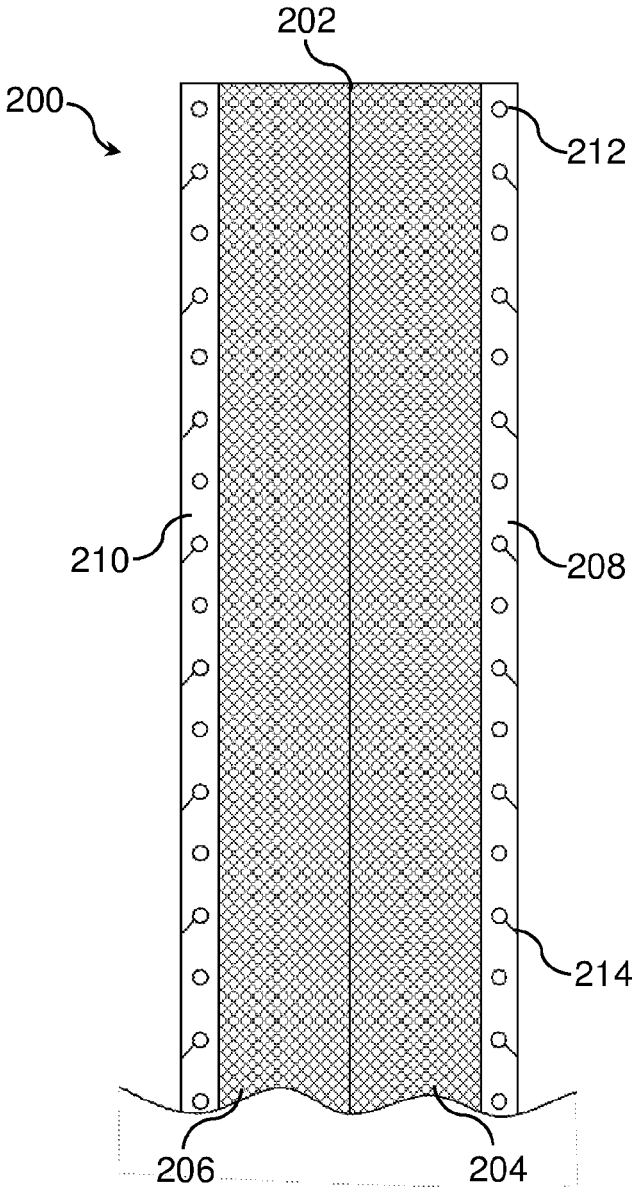
FIG. 2A shows a front view of a second example embodiment of a wall bead according to the present invention.
Figure 2B:
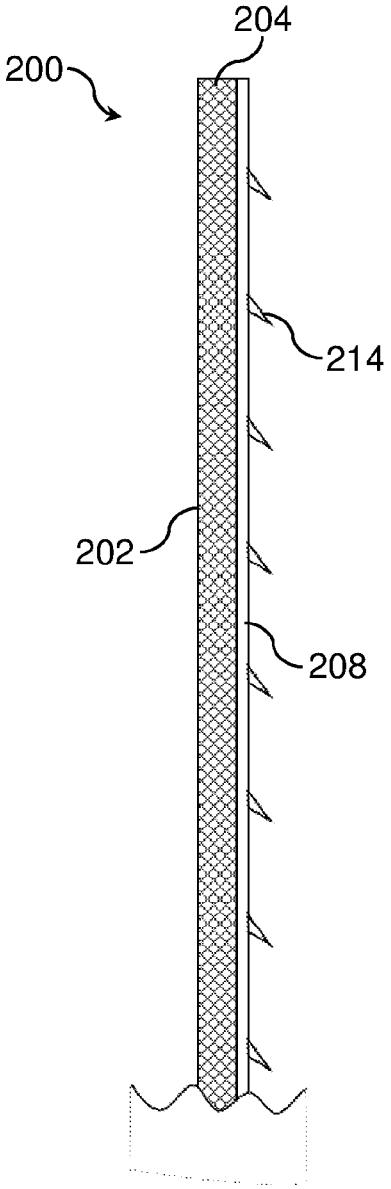
FIG. 2B shows a lateral view of the embodiment of FIG. 2A.
Figure 2C:
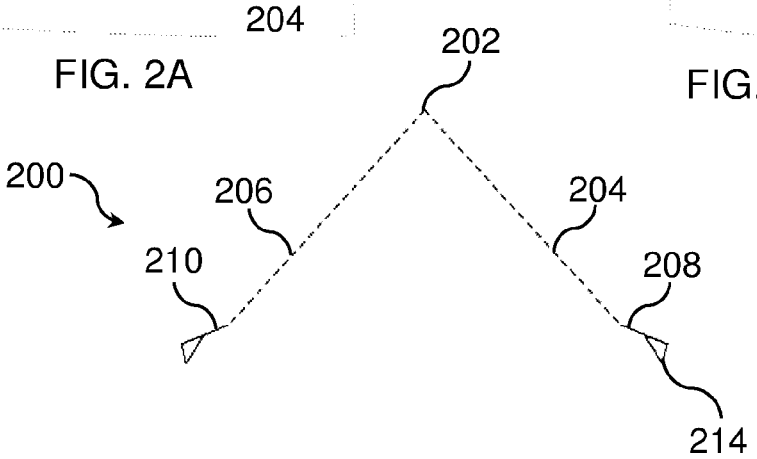
FIG. 2C shows a sectional plan view of the embodiment of FIG. 2A and FIG. 2B.

FIG. 2A to FIG. 2C show a second example embodiment 200 of a wall bead 200 wherein the central portion 202 forms a longitudinal join between adjacent longitudinal edges of a first stainless steel mesh panel 204 and a second mesh panel 206 substantially the same as the first panel 204. Each panel 204, 206 extends in its respective plane each defined by opposing directions from the join 202 as can be seen in the sectional plan view of FIG. 2C. The bead 200 comprises a first connection portion 208 extending from the first mesh panel 204 and a second connection portion 210 extending from the second mesh panel 206, the second connection portion 210 being a mirror image of the first connection portion 208. As with the first embodiment 100 described in relation to FIG. 1A to FIG. 10, the connection portions 208, 210 of the second embodiment 200 comprise a plurality of apertures 212 distributed at regular intervals along the connection portions 208, 210, and a plurality of barbs 214 protruding from the connection portions 214. The barbs 214 protrude from a surface of the first connection portion 208 and the second connection portion 210 at an acute angle relative to the surface, the surface being intended to be directed toward a plasterboard wall for fixation of the wall bead thereto using the barbs 214.

In use, the wall bead 200 shown in FIG. 2A to FIG. 2C is arranged to provide complete flexibility of the bead in situations wherein the relatively inflexible central portion 102 of the previous embodiment 100 may be undesirable. The continuous nature of the communication between the first panel 204 and the second panel 206 along the longitudinal edge 202 permits maximum flexibility of the bead.

Figure 3A:
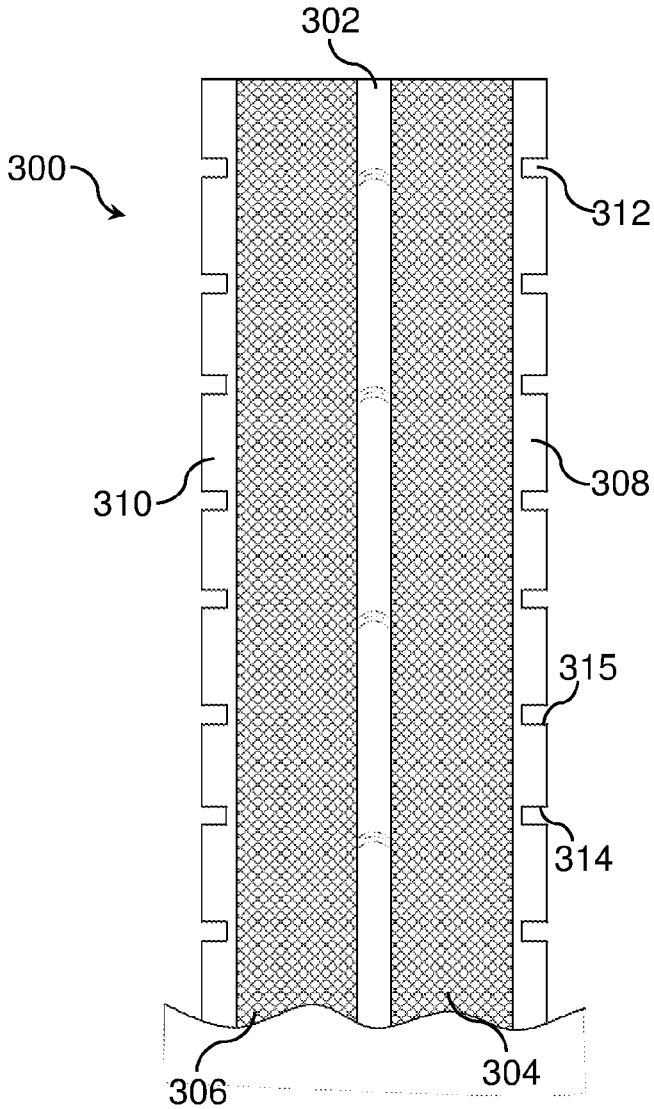
FIG. 3A shows a front view of a third example embodiment of a wall bead according to the present invention.
Figure 3B:
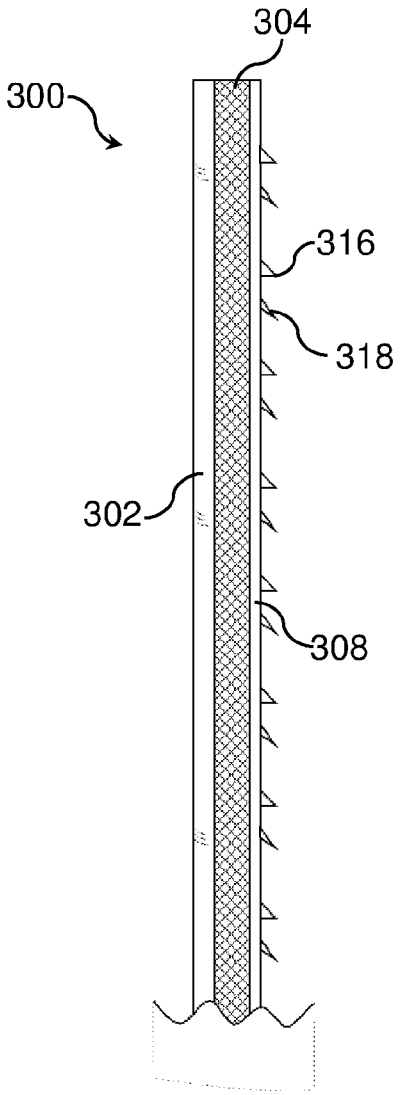
FIG. 3B shows a lateral view of the embodiment of FIG. 3A.
Figure 3C:
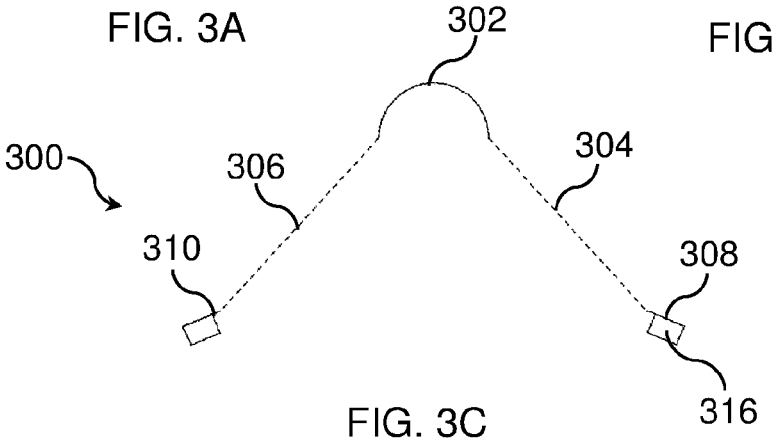
FIG. 3C shows a sectional plan view of the embodiment of FIG. 3A and FIG. 3B.
Figure 4A:
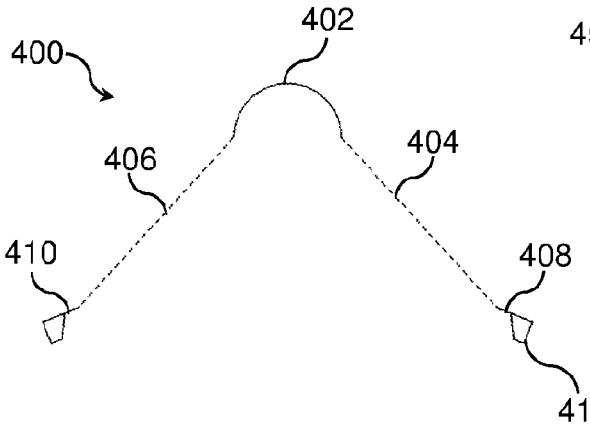
FIG. 4A shows a sectional plan view of fourth embodiment of a wall bead according to the present invention.
Figure 4B:
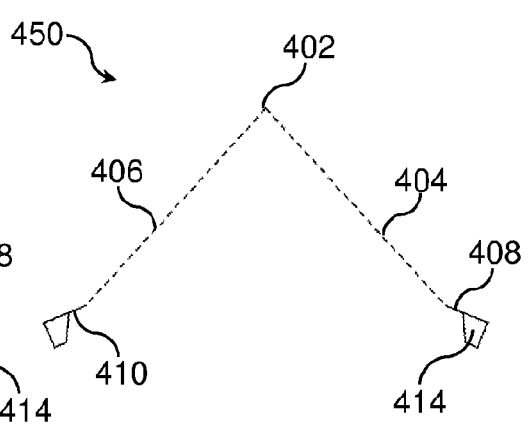
FIG. 4B shows a sectional plan view of an alternate embodiment to that shown in FIG. 4A.

Referring to FIG. 3A, FIG. 3B and FIG. 3C, a third embodiment 300 of a wall bead according to the present invention is shown wherein a push bead is provided arranged to be affixed to the corner of a wall by pushing the bead 300 into a wall substrate, such as plasterboard. The wall bead 300 comprises a central portion 302 and first and second planar panels 304, 306 equivalent to those described for the embodiment 100 of FIG. 1A to FIG. 10. The third embodiment 300, however, comprises a first connection portion 308 extending from the first planar panel 304 and a second connection portion 310 extending from the second planar panel 306, the first and second connection portions 308, 310 comprising a series of rectangular grooves 312 therein, each having an upper surface 314 and a lower surface 315. As can be seen from the lateral view of FIG. 3B, the bead 300 also comprises a plurality of teeth 316, 318 protruding from a surface of the first connection portion 308 intended to be in contact with a wall surface. The second connection portion 310 also comprises said plurality of teeth 316, 318 (not shown). Two series of teeth 316, 318 are provided, with the first series 316 extending from the upper surface 314 of the grooves 312 perpendicular to the surface of the respective connection portion 308, 310. A second series of teeth 318 extend from the lower surface 315 of the grooves 312 in a direction away from the upper surface 315 such that an acute angle is provided between the second series of the teeth 318 and the surface of the respective connection portion 308, 310. As can be seen in the section plan view of FIG. 3C, the teeth 316, 318 have rectangular upper surface.

Additional sectional plan views of alternative embodiments of the present invention can be seen in FIG. 4A, FIG. 4B, FIG. 5A and FIG. 5B. In the embodiments 400, 450 of FIG. 4A and FIG. 4B, like numbering is used to represent equivalent parts. In each embodiment 400, 450, a central longitudinally extending section 402 is shown having first and second planar panels 404, 406 extending therefrom. Extending from the planar panels 404, 406 are a respective first and second connection portion 408. 410 comprising a plurality of teeth 414 protruding therefrom. The embodiment 400 of FIG. 4A comprises a central portion 402 equivalent to that of the embodiment 100 of FIG. 1A to FIG. 10. The embodiment 450 of FIG. 4B comprises a central portion 402 equivalent to that of the embodiment 200 of FIG. 2A to FIG. 2C. In each embodiment 400, 450 the teeth 414 extend at an acute angle relative to a surface of the respective connection portion 408, 410, said surface being intended to communicate with a wall surface. The teeth 414 comprise a roughly trapezoid shape which may be suitable for particular wall substrates.

Figure 5A:
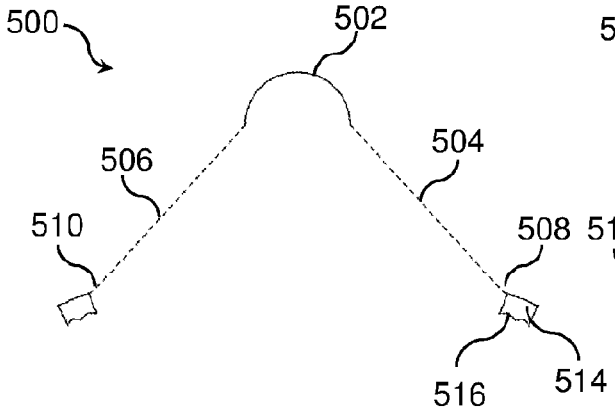
FIG. 5A shows a sectional plan view of fifth embodiment of a wall bead according to the present invention.
Figure 5B:
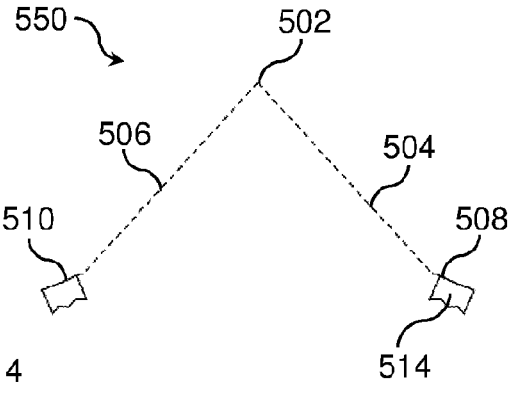
FIG. 5B shows a sectional plan view of an alternate embodiment to that shown in FIG. 5A.

In the embodiments 500, 550 of FIG. 5A and FIG. 5B, like numbering is used to represent equivalent parts. In each embodiment 500, 550, a central longitudinally extending section 502 is shown having first and second planar panels 504, 506 extending therefrom. Extending from the planar panels 504, 506 are a respective first and second connection portion 508. 510 comprising a plurality of teeth 514 protruding therefrom. The embodiment 500 of FIG. 5A comprises a central portion 502 equivalent to that of the embodiment 200 of FIG. 2A to FIG. 2C. The embodiment 550 of FIG. 5B comprises a central portion 502 equivalent to that of the embodiment 200 of FIG. 2A to FIG. 2C. In each embodiment 500, 550 the teeth 514 extend at an acute angle relative to a surface of the respective connection portion 508, 510, said surface being intended to communicate with a wall surface. The teeth 514 comprise a roughly rectangular shape having a serrated surface 516, which may be suitable for particular wall substrates, such as more dense substrates or those comprising a cover material through which the tooth penetrates. The serrated surface 516 permits easier entry of the teeth 514 into said substrate while maintaining the surface area of the rectangular teeth 514. A relatively large surface area across the connection between the teeth and the wall surface, such as that provided by the rectangular teeth 514, improves the robustness of said connection. A serrated surface 516 provides the additional advantage of improved entry of said teeth 514 into the wall substrate.

Figure 6:
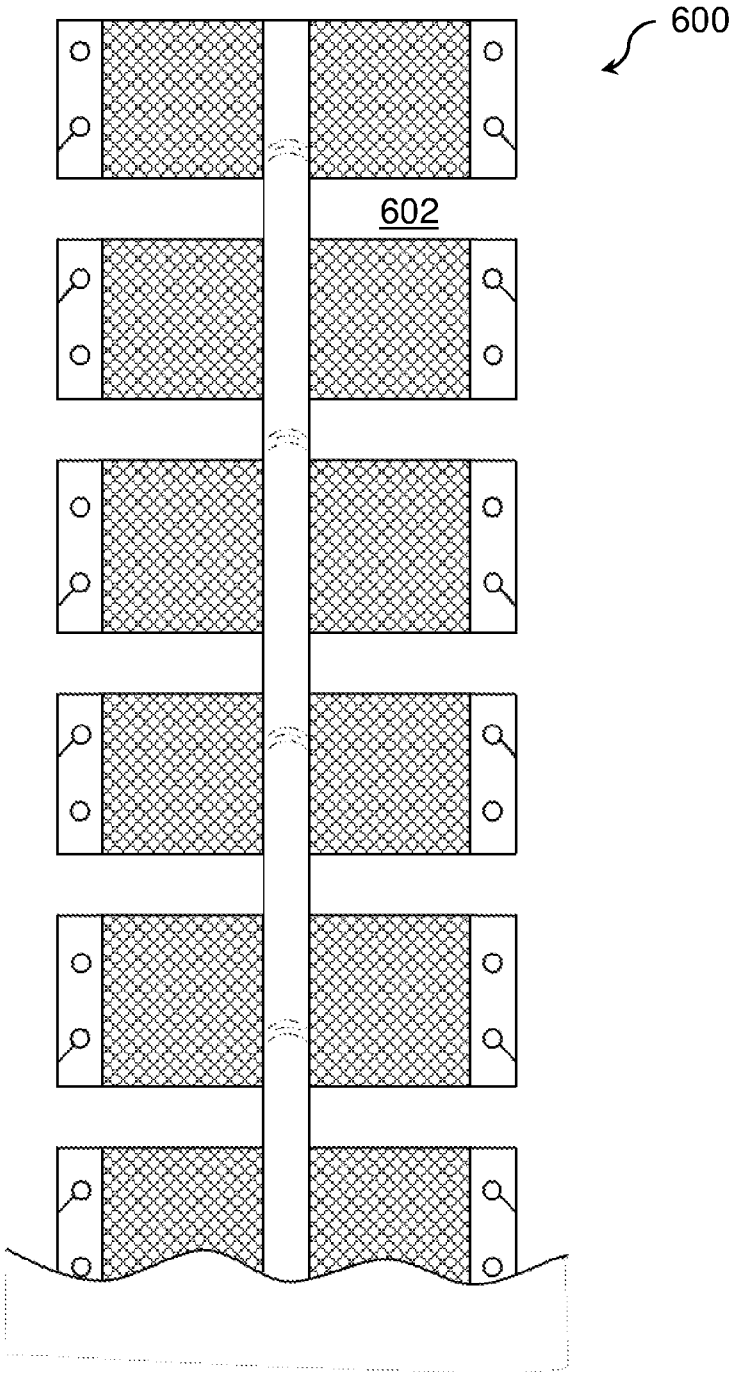
FIG. 6 shows a front view of a sixth example embodiment of a wall bead according to the present invention.

Referring to FIG. 6, an example embodiment 600 of a wall bead is shown having enhanced flexibility compared to the embodiment 100 of FIG. 1A to FIG. 10. The wall bead 600 comprises lateral grooves 602 distributed along the panels such that the panels have improved flexibility and can therefore conform to the contour of a non-flat wall surface.

Figure 7A:
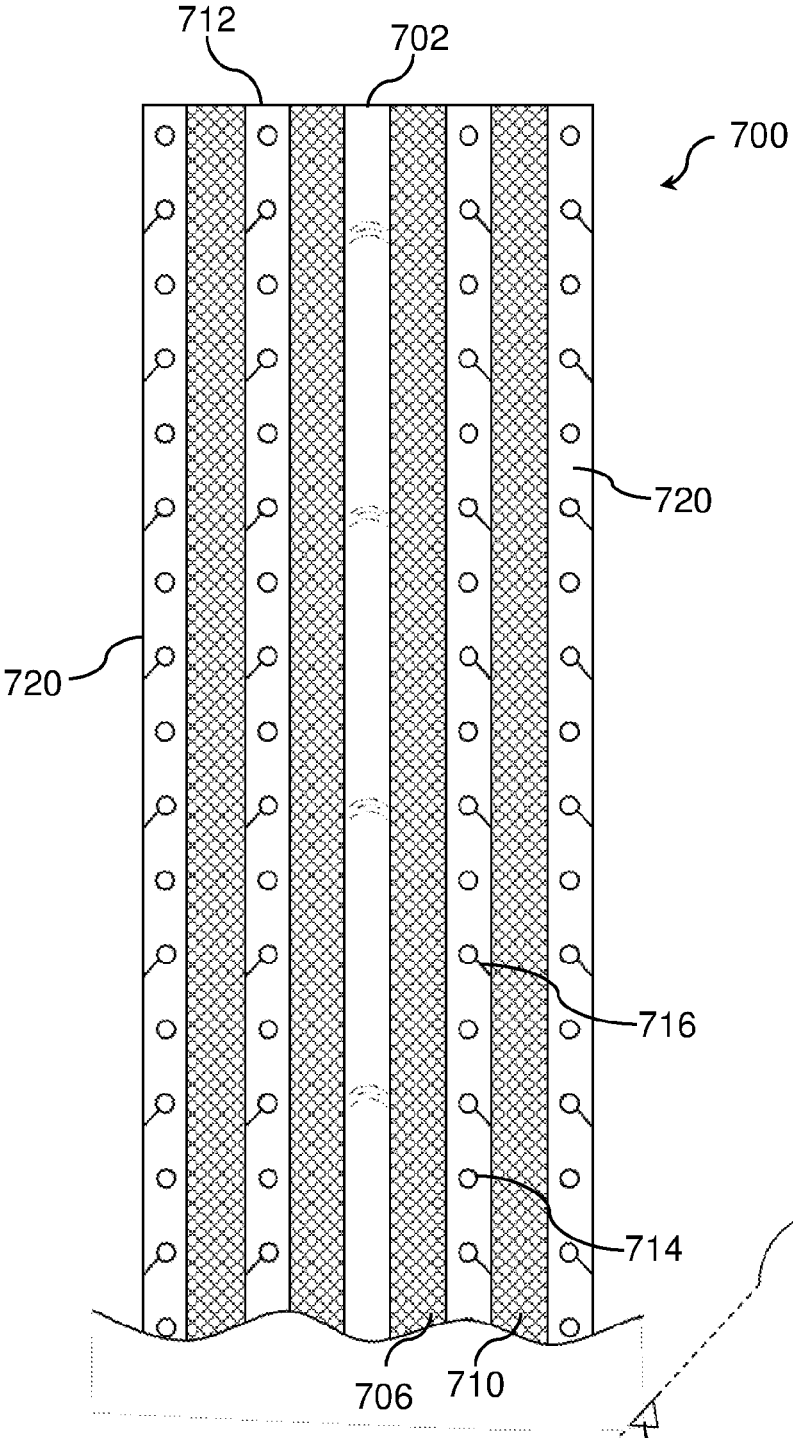
FIG. 7A shows a front view of a seventh example embodiment of a wall bead according to the present invention.
Figure 7B:
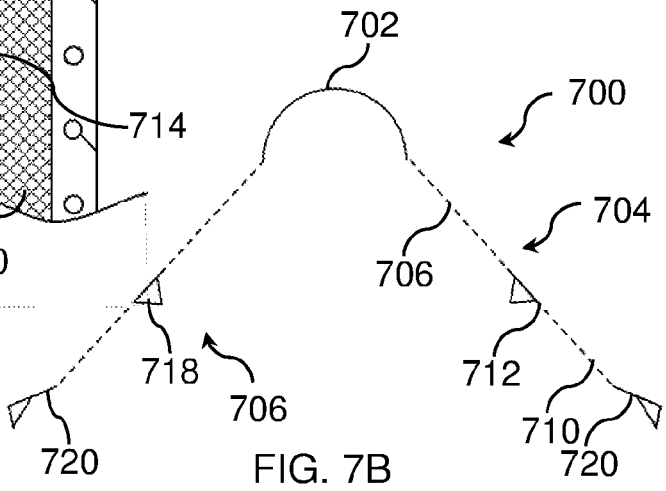
FIG. 7B shows a sectional plan view of the embodiment of FIG. 7A.

Referring to FIG. 7A and FIG. 7B, an example embodiment 700 of a semi-rigid wall bead in accordance with the present invention is shown, the semi rigid wall bead 700 comprising a curved central portion 702, a first planar panel 704 extending from a first longitudinal edge of the central portion 702, a second planar panel 706 extending from a second longitudinal edge of the central portion 702, the second longitudinal edge opposing the first longitudinal edge. The first and second planar panels 704, 706 each comprise a first mesh panel portion 708 and a second mesh panel portion 710 separated by a solid panel portion 712 therebetween. The solid panel portion 712 of the first and second panels 704, 706 comprises a plurality of apertures 714 distributed along the length thereof. Extending from each even-numbered of said apertures 714 toward an outermost edge of the respective solid panel portion 712 is a slit 716 each forming a tooth 718 in the solid panel portion 712. The outermost edge will be understood to be distal to the central portion 702. Extending from the second mesh panel portion 710 is a connection portion 720 which, in the example embodiment shown, is substantially the same as the solid panel portion 712.

In use, the solid panel portions 712 of the example embodiment 700 of FIG. 7A and FIG. 7B provide a semi-rigid structure arranged to be less flexible than embodiments comprising first and second panels consisting entirely of mesh. Such examples 700 may be more suitable for corners which are less aggressive or wherein the flexible nature of the mesh is less important than the structural integrity of the wall bead. The solid panel portion 712 in the embodiment shown comprises teeth 718 which preferably cooperate with the teeth of the connection portion 720 to provide improved connection to a wall. Embodiments will be appreciated wherein the solid panel portion does not comprise teeth. Embodiments will further be appreciated wherein the teeth of the solid panel portion 712 and the teeth of the connection portion 720 are angled such that the teeth of the solid panel portion 712 oppose the corresponding teeth of the connection portion 720. Such opposing of the teeth preferably provides improved connection of a wall bead to a wall.

Figure 8A:
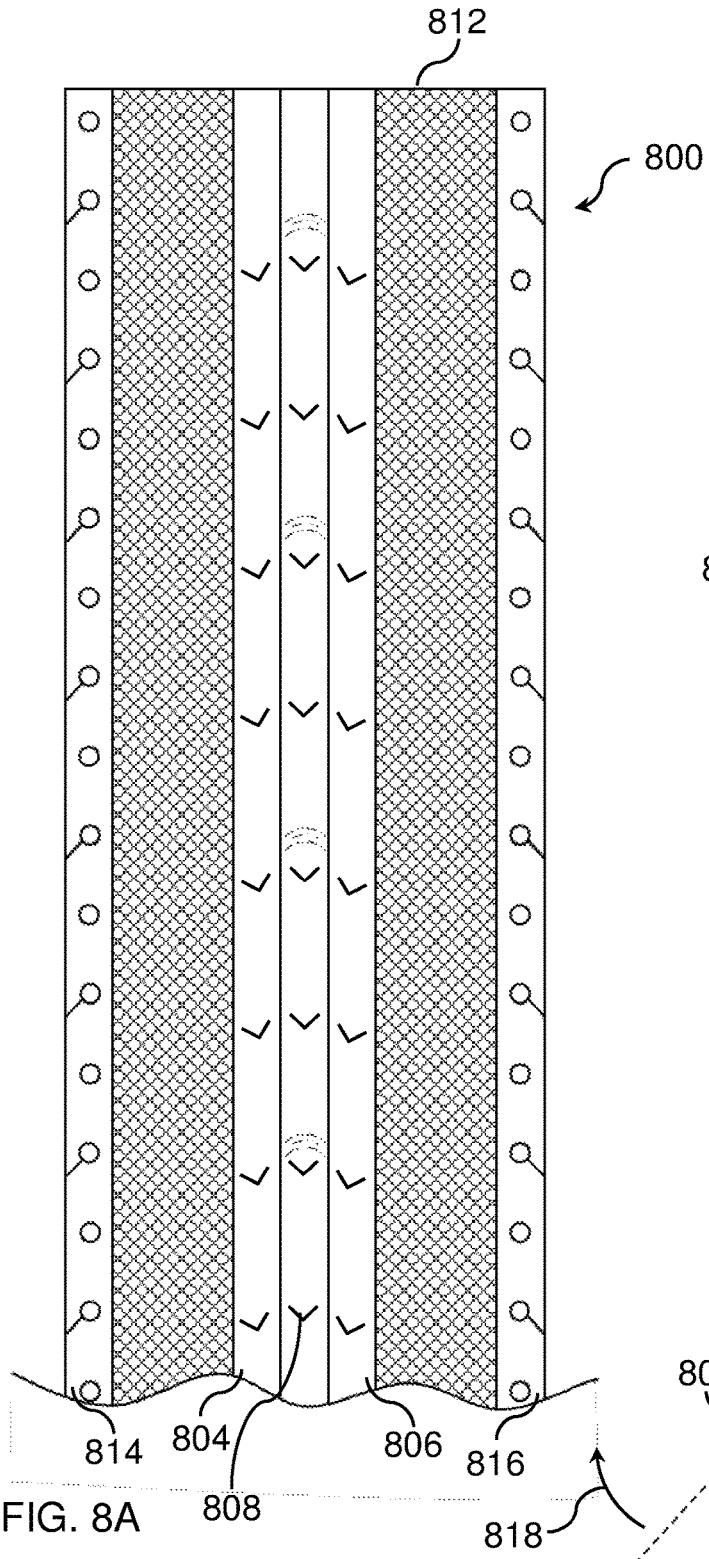
FIG. 8A shows a front view of an eighth example embodiment of a wall bead according to the present invention.
Figure 8B:
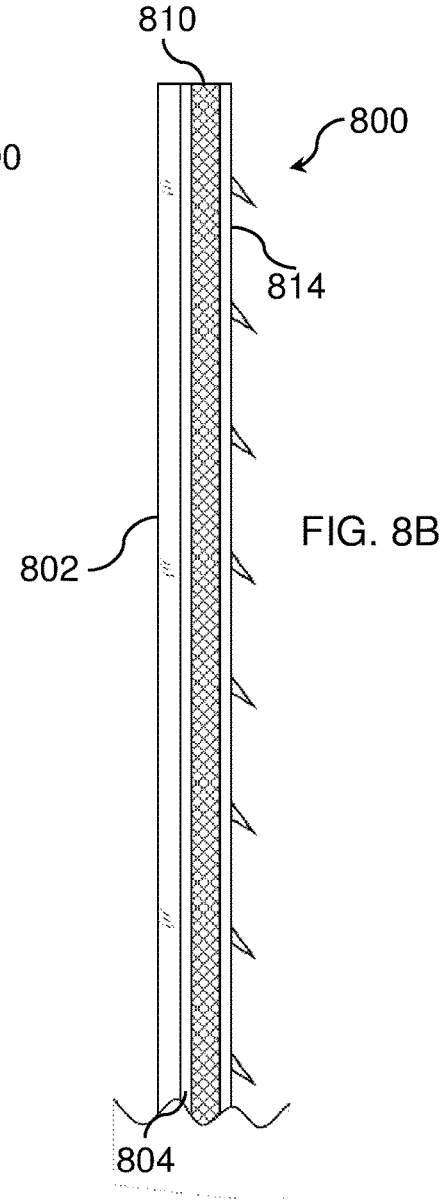
FIG. 8B shows a lateral view of the embodiment of FIG. 8A.
Figure 8C:
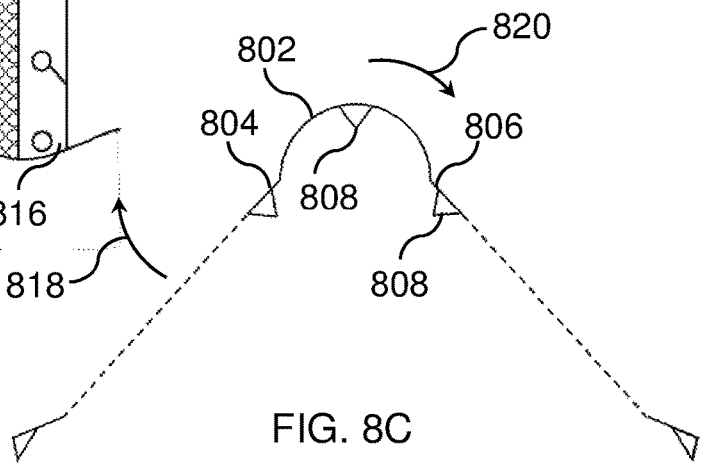
FIG. 8C shows a sectional plan view of the embodiment of FIG. 8A and FIG. 8B.

Referring to FIG. 8A to FIG. 8C, and example embodiment 800 of a wall bead having toothed guides for easier alignment and improved lateral restraint is shown. The wall bead 800 comprises an elongate central portion formed of a central curved portion 802 having a solid semicircular cross-section extending along the length of the curved portion 802. The curved portion 802 comprises a first and second longitudinal edge extending along the length thereof. Extending outwardly from the first longitudinal edge of the curved portion 802 is a first solid planar panel 804 of the central portion. Extending outwardly from the second longitudinal edge of the curved portion 802 is a second solid planar panel 806 of the central portion. As can be seen in FIG. 8C, the first panel 804 of the central portion and the second panel 806 of the central portion are angled at roughly 90° to one another. Distributed along the curved portion 802, the first panel 804 of the central portion and the second panel 806 of the central portion, and protruding therefrom, are a plurality of teeth 808 being roughly triangular in shape. Extending from the first panel 804 of the central portion is a first planar mesh portion 810 and extending from the second panel 806 of the central portion is a second planar mesh portion 812. Extending from the first planar mesh portion 810 is a first connection portion 814, and extending from the second planar mesh portion 812 is a second connection portion 816. Each of the first and second connection portions 814, 816 comprise a plurality of apertures distributed evenly along the length thereof, a portion of the apertures comprising a slit extending to the outermost wall of the respective connection portion each forming a tooth. The first and second planar mesh portions 810, 812 and the first and second connection portions 814, 816 are substantially as hereinbefore described for the first example embodiment 100 of FIG. 1A to FIG. 10.

In use, the first and second planar panels 804, 806 of the central portion form guides for affixing the wall bead 800 to a corner of a wall (not shown). The teeth 808 act as anchor points for the wall bead 800 in the wall and provide lateral restraint against removal of the wall bead 800 from said wall. Upon rotation of the first panel 804 and first mesh portion 810 in the direction 818 shown, a rotational force 820 about the central portion causes the opposing second panel 806 and the teeth 808 thereon to engage with the wall more rigorously. As such, said consequent rotational action 820 preferably acts to cause the wall bead 800 to grip the wall surface more robustly and is therefore more difficult to remove. As an advantage, such an embodiment is preferably more difficult to move on or remove from a wall surface by accident during subsequent preparation of the wall surface to be coated with, for example, plaster. It will be understood that opposite forces to those described will cause equally improved gripping by teeth 808 of the opposing panel 804 of the central portion.

Figure 9:
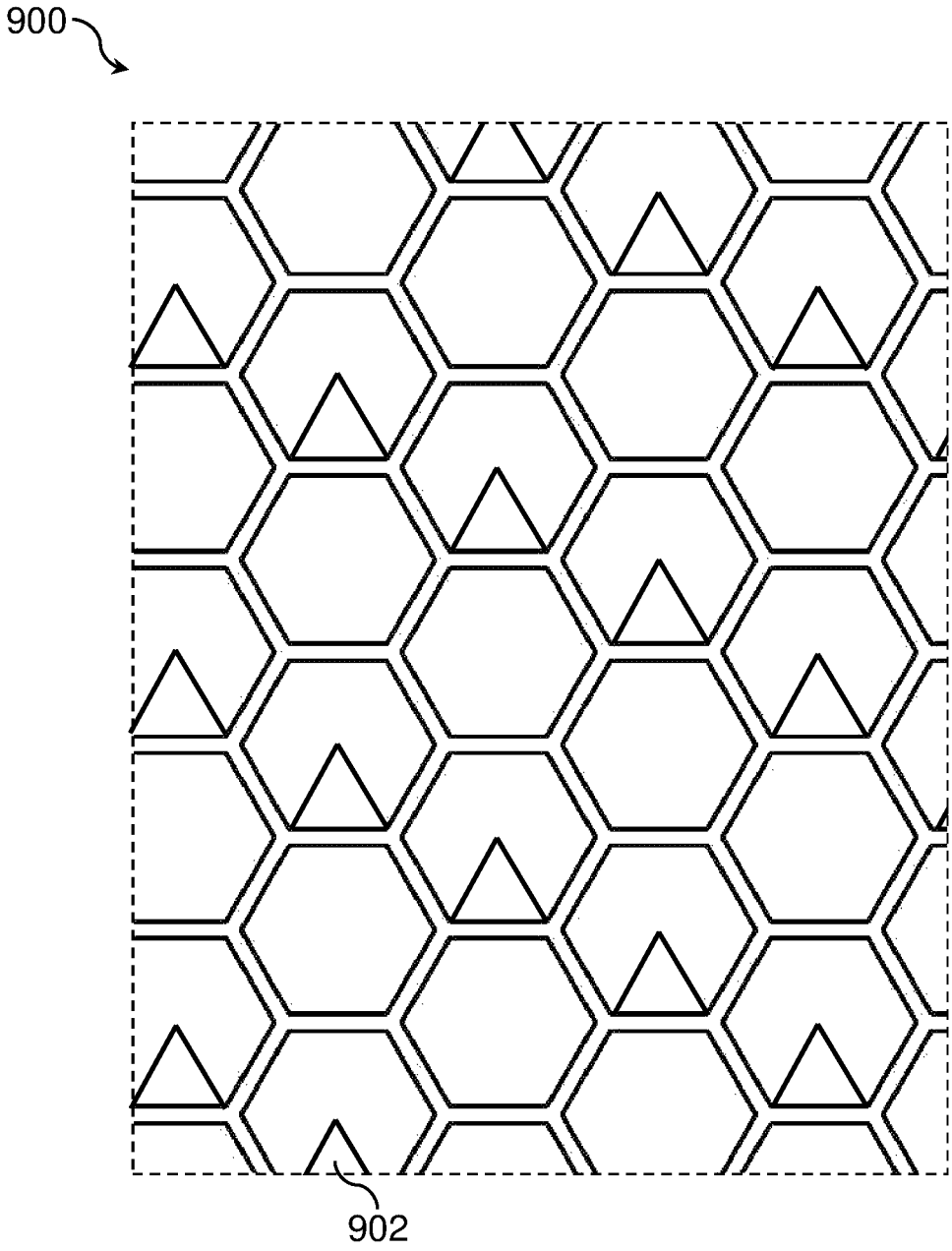
FIG. 9 shows an enlarged view of an example mesh structure for use with the present invention.

Referring to FIG. 9, an example mesh arrangement 900 is shown suitable for use with a wall bead according to the present invention. The mesh arrangement 900 comprises a mesh having teeth 902 formed therefrom. The teeth 902 are formed with the mesh during the manufacturing process. Teeth 902 formed with the mesh 900 preferably provide improved robustness of a connection of the mesh 900 to a wall surface and preferably aid improved contouring of the mesh 900 with non-flat wall surface, such as a curved wall surface for example.

The plan sectional view shown in FIG. 10A shows an alternate embodiment 1000 substantially as described with reference to FIG. 10 wherein the teeth 1002 are instead angled inwardly such that they form an approximately acute angle with their respective connection portion. Teeth 1002 such as those comprised within the alternate embodiment 1000 of FIG. 10A may provide a wall bead 1000 which is more difficult to remove from a wall surface, wherein an outward force placed on the wall bead 1000 causes the teeth 1002 thereon to grip the wall surface more robustly. The example embodiment 1100 shown in FIG. 10B is substantially as described for the embodiment 100 of FIG. 10 but instead comprises teeth formed of a first tooth 1102 and a smaller second tooth 1104, formed within the first tooth 1002, and having a smaller angle relative to the respective connection portion 1106. Such dually-formed teeth, formed of a triangle within a triangle, for example, preferably provide improved gripping of a wall bead to a wall surface and therefore provide for more difficult removal. The alternate example embodiment 1200 of FIG. 100 is substantially as hereinbefore described with reference to FIG. 10 wherein the teeth are formed of a first tooth portion 1202 and a second tooth portion 1204 extending therefrom at an angle relative to the first tooth portion 1202. Such angled, or in some case curved, teeth can provide improved connection of a wall bead to a wall surface for more difficult removal.

It will be appreciated that the above described embodiments are given by way of example only and that various modifications may be made to the described embodiments without departing from the scope of the invention as defined in the appended claims. For example, in the embodiments shown and described, a right angle wall bead is represented. Embodiments of the present invention will be appreciated wherein the wall bead comprises an acute or obtuse angle to better suit a wall to which the bead is intended to be applied. The corner of the wall to which the wall bead is applied may comprise a different angle at one point along the length of the corner compared to an angle at another point along the length of the corner. The present wall bead, comprising the flexible mesh, is therefore arranged to suit a corner of any angle, or of mixed angles, and is preferably ideally suited to corners having a surface thereof which is non-flat, such as concave or convex. Embodiments of the present invention will be appreciated wherein the wall bead is a rounded, or bullnose bead for producing a rounded corner of a wall. Other suitable forms of wall bead will be appreciated. Embodiments are shown having apertures extending along the connection portion or the solid panel portions intended for, for example, screws or nails. Embodiments will be appreciated wherein the formation, structure or frequency of the teeth is such that no other affixing means are required to affix the wall bead to a wall surface and such said embodiments may not comprise said screw or nail apertures.

The invention claimed is:

1. A wall bead, the wall bead comprising:

a central longitudinally extending portion having a first longitudinal edge and a second longitudinal edge opposing the first edge;

a first planar panel extending from the first edge;

a second planar panel extending from the second edge;

a first connection portion extending from the first panel; and a second connection portion extending from the second panel;

wherein the first connection portion and the second connection portion each comprise a plurality of teeth protruding therefrom and distributed along a longitudinal length thereof; and wherein the first and second panel each comprise a flexible mesh or woven material such that the first and second panel are arranged to deviate from their respective planes such that the first and second panel are arranged to conform to a contour of a wall surface; and wherein at least one of the flexible mesh or woven material comprises teeth formed therefrom.

2. A wall bead as claimed in claim 1, wherein the plurality of teeth comprise a first set of teeth arranged to extend from a surface of the first connection portion and the second connection portion, and a second set of teeth arranged to extend from a surface of the first connection portion and the second connection portion, the first set of teeth and the second set of teeth positioned in spaced pairs at longitudinal positions along the first connection portion and the second connection portion.

3. A wall bead as claimed in claim 2, wherein the second set of teeth extend from the surface at an angle of less than 900 relative to the surface.

4. A wall bead as claimed in claim 1, wherein the plurality of teeth each comprise a pointed distal end and are generally triangular in shape.

5. A wall bead as claimed in claim 1, wherein the plurality of teeth each comprise a generally straight distal end and generally trapezoid in shape.

6. A wall bead as claimed in claim 1, wherein the plurality of teeth each comprise a serrated edge having a non-linear profile.

7. A wall bead as claimed in claim 1, wherein a front surface of the first and second panels are angularly spaced about the central portion by an angle of less than 180°.

8. A wall bead as claimed in claim 7, wherein the angle is substantially 90°.

9. A wall bead as claimed in claim 1, wherein the flexible mesh or woven material is one selected from the group: stainless steel; mild steel; galvanised metal.

10. A wall bead as claimed in claim 1, wherein the first connection portion and the second connection portion each comprise a connection portion material which is a continuous, unmeshed material.

11. A wall bead as claimed in claim 10 wherein the connection portion material is one selected from the group: stainless steel; mild steel; galvanised metal.

12. A wall bead as claimed in claim 1, wherein the central portion comprises a central portion material which is a continuous, unmeshed material.

13. A wall bead as claimed in claim 12, wherein the central portion material is one selected from the group: stainless steel; mild steel; galvanised metal.

14. A wall bead as claimed in claim 1, wherein the central portion provides a bridging connection between the first panel and the second panel.

15. A wall bead as claimed in claim 14, wherein the bridging connection comprises a generally semicircular profile.

* * * * *